US005236085A

United States Patent [19]

Quellais

[11] Patent Number: 5,236,085

[45] Date of Patent: Aug. 17, 1993

[54] GOLF BAG EQUIPPED WITH A SUPPORT

[75] Inventor: Jacques Quellais, Saint-Jorioz, France

[73] Assignee: Salomon S. A., Chavanod, France

[21] Appl. No.: 908,463

[22] Filed: Jul. 6, 1992

[30] Foreign Application Priority Data

Jul. 4, 1991 [FR] France ..... 91 08632

[51] Int. Cl.[5] ..... A63B 55/00

[52] U.S. Cl. ..... 206/315.7; 248/96

[58] Field of Search ..... 206/315.7, 315.3; 248/96, 171, 688, 297.2

[56] References Cited

U.S. PATENT DOCUMENTS

| | | | |
|---|---|---|---|
| 1,757,471 | 5/1930 | Platt | 248/96 |
| 3,195,844 | 7/1965 | Roepke | 206/315.7 X |
| 4,620,682 | 11/1986 | Yim | 248/96 |
| 4,834,235 | 5/1989 | Solheim et al. | 206/315.7 |
| 4,921,192 | 5/1990 | Jones | 248/96 |
| 4,949,844 | 8/1990 | Yang | 206/315.7 |
| 5,036,974 | 8/1991 | Ross, Jr. | 206/315.7 |
| 5,042,654 | 8/1991 | Jones | 206/315.7 X |
| 5,082,218 | 1/1992 | Hoffman | 206/315.1 X |
| 5,147,089 | 9/1992 | Anderson | 206/315.7 X |
| 5,152,483 | 10/1992 | Maeng | 206/315.7 X |
| 5,154,377 | 10/1992 | Suk | 206/315.7 X |
| 5,156,366 | 10/1992 | Anderson | 248/96 |

FOREIGN PATENT DOCUMENTS

| | | |
|---|---|---|
| 1160447 | 8/1969 | United Kingdom . |
| 2233910 | 1/1991 | United Kingdom . |

*Primary Examiner*—Allan N. Shoap
*Assistant Examiner*—Christopher J. McDonald
*Attorney, Agent, or Firm*—Pollock, Vande Sande & Priddy

[57] ABSTRACT

Golf bag constituted by an upper end shield connected to a lower end shield by means of a peripheral cover and comprising a support incorporating two props, the upper end of each being jointed to the bag around a respective axis so as to rotate between two positions, i.e., a retracted resting position and a an extended position, these props being stressed into their retracted resting position by an elastic system constituted by an elastic U-shaped stirrup piece comprising two arms which extend upward and whose free ends are fastened to the props by a joint, and in which the end of the lower central part constitutes the device activating the support. The activation device is positioned in the half-space located above the plane formed by the support surface of the bottom of the bag, and extends outward away from the peripheral cover of the bag, so as to lie outside of the plane containing the two arms and at a distance from the point of support of the bag when the latter is in the inclined position.

11 Claims, 5 Drawing Sheets

GOLF BAG EQUIPPED WITH A SUPPORT

FIELD OF THE INVENTION

The present invention relates to a golf bag comprising a support incorporating retractable props allowing the user to lay the bag down in an inclined position on the ground.

BACKGROUND OF THE INVENTION

Golf bags in which the various clubs used for play are arranged are either placed on a wheeled cart which the golfer pulls or are carried directly by the golfer using a carrying strap.

When the bag is placed on a cart, it lies in an inclined position in relation to the ground. The golfer takes out and replaces his clubs without difficulty during play.

However, not all golfers like to use a cart, and some prefer to carry their bag. When each shot is made, the bag must be placed horizontally on the ground, thereby making it difficult to take out the clubs and put them back.

Manufacturers have thus devised supports to hold the bag either vertically or slightly inclined in relation to the ground. Different types of supports are thus known in which two props are movable between a retracted, resting position and an extended position. In their retracted position, the props are positioned against the bag, while, in their extended position, they protrude and allow the bag to be held in an inclined position on the ground. The degree of the inclination of the bag depends on the length of the props.

This type of support is, for example, described in U.S. Pat. No. 2,064,052, which discloses a bag held on the ground by two small retractable props. This support definitely solves the problem of holding the bag in place, but exhibits a number of disadvantages, in particular that of not being automatic, since the user must manually move the props between their retracted and extended position, and. Moreover, the shortness of the props gives the bag an excessively inclined position, which makes it difficlt for the golfer to take out or put back his clubs.

To overcome these disadvantages, automatic supports incorporating longer props have been proposed. For example, the support disclosed in British Specification No. 2,098,075 may be mentioned. The support described therein comprises two retractable props jointed on a common shaft, whose movement into an extended position is controlled by a control device extending downward beyond the bottom of the bag. Thus, when the golfer places his bag on the ground, the control device in contact with the ground travels upward and causes the props to be brought into the extended position. This type of support proves only partially satisfactory, since the projecting control device beneath the bottom of the bag is especially bothersome. In fact, each time and in whatever position the golfer lays down his bag, the props deploy.

SUMMARY OF THE INVENTION

The present invention attempts to solve the disadvantages of previous supports, and thus proposes a bag whose retractable support is particularly simple and reliable, and whose control device does not impair use of the bag. In fact, according to the invention, the props extend only when the user wishes to place his bag in the inclined position.

Thus, the golf bag according to the invention is constituted by an upper shield connected to a lower shield by means of a peripheral cover, and it comprises a support incorporating two props, the upper end of each being jointed to the bag so as to be free to rotate between two positions, i.e., a retracted resting position and an extended position, these props being drawn into their retracted resting position by an elastic system constituted by an elastic U-shaped stirrup piece which comprises two arms extending upward and whose free ends are fastened to the props by a joint, and in which the end of the lower central part constitutes the device controlling this support. The control device is positioned in the half-space located above the plane formed by the support surface of the bottom of the bag, and extends outward away from the peripheral cover of the bag so as to lie outside of the plane containing the two arms and at a distance from the support point of the bag when the latter is in the inclined position.

According to another feature, the golf bag is configured so that the lower periphery of the lower shield lies substantially within the extension of the wall of the peripheral cover, and the lower part of the arms of the elastic stirrup piece is held in a vertical sliding configuration by a retention device.

According to a complementary feature, the prop-articulation axes converge to the outside of the bag.

BRIEF DESCRIPTION OF THE DRAWINGS

Other features and advantages of the invention will emerge by virtue of the following description provided with reference to the attached drawings furnished as examples.

DESCRIPTION OF THE PREFERRED EMBODIMENT

Figure 1:
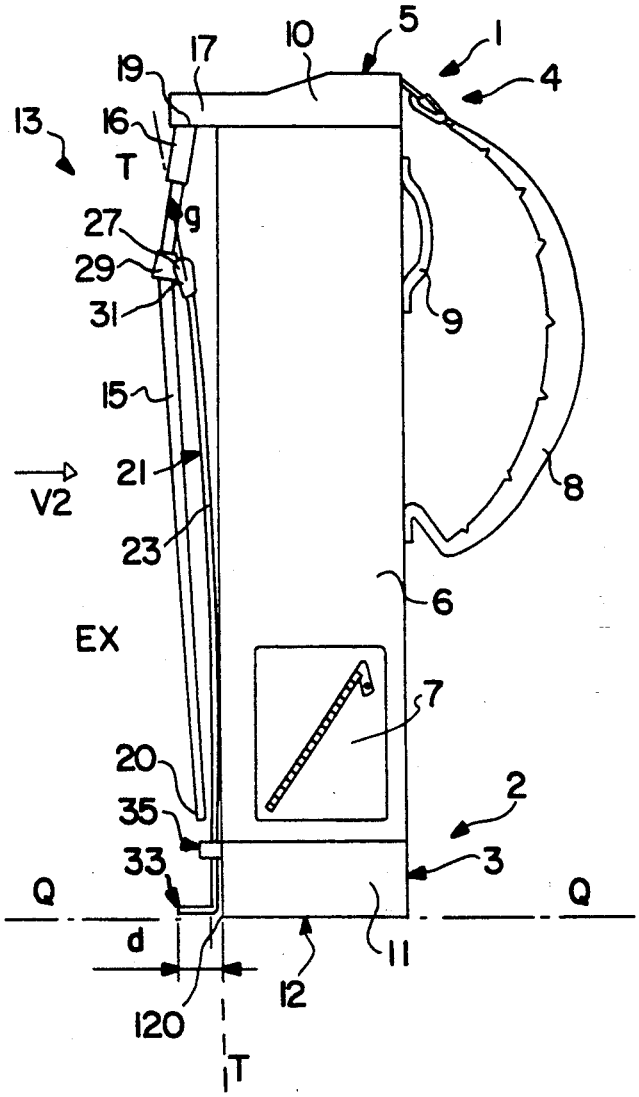
FIG. 1 is a side view of a golf bag with support according to the invention in its retracted resting position.

The golf bag comprises in conventional fashion, a shield (3) in its lower part (2) in conventional fashion, a lower shield (3) in its lower part (2) and, in its upper part (4), an upper shield (5). The lower and an upper shield (5) in its upper part (4). The lower and upper shields (3, 5) are connected by a peripheral cover (6), which forms the outer wall of the bag itself. The shields are advantageously made of a plastic material, while the peripheral cover is made of a rigid or semi-rigid, or supple material such as a plastic fabric, or of leather.

The bag further comprises a group of pockets (7), a carrying strap (8), and a handle (9).

The upper shield (5) is constituted by an upper peripheral edge (10) so as to form the top of the bag, through which the golf clubs are inserted.

The lower shield (3) is constituted by a lower peripheral edge (11) and by a bottom (12), so as to form the support surface for the bag when it is placed vertically on the ground.

The support surface of the bottom of the bag is configured so that its periphery 120 lies within the extension of the peripheral cover (6). The support surface is thus substantially equal to the horizontal section of the bag, and, when the bag is in the inclined position, the point of contact (C) between the bottom (12) and the ground (S) is a lateral point of the support surface located on the periphery (120).

The retractable prop-equipped support (13) comprises two retractable props (14, 15) which can pivot between a retracted resting position and an extended position. To this end, each of the props (14, 15) is jointed by its upper end (16) to a position-retention shoulder (17) around an axis of articulation. Thus, the first prop (14) is jointed around a first axis (18), while the second prop (15) is jointed around a second axis (19). The first axis (18) converges with the second axis (19) at a point (O) located outside the bag. This configuration of the axes of articulation creates a relative spatial separation (E) of the lower ends (20) of the props when they are extended, thereby allowing the bag to be supported more firmly. In fact, in their extended position, the two props converge upward so as to form an angle (G) opening downward, and the bag is then supported at three points (A, B and C).

In the extended position, the props are stressed toward their resting position by elastic return means constituted by an elastic U-shaped stirrup piece (21) having two upwardly extending arms (22, 23) and whose free ends (24, 25) are attached to the respective props (14, 15) by joints (26, 27). To this end, each prop is equipped with a cap (28, 29) comprising a hole (30, 31), and each end of each arm comprises an end piece (220, 230) extended laterally and internally by a pin (26, 27) designed to fit into this hole in the cap.

Figure 7:
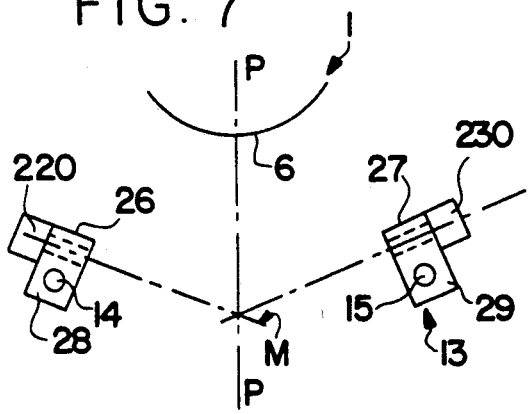
FIG. 7 is a partial top view illustrating the props and their attachment to the elastic stirrup piece.
Figure 8:
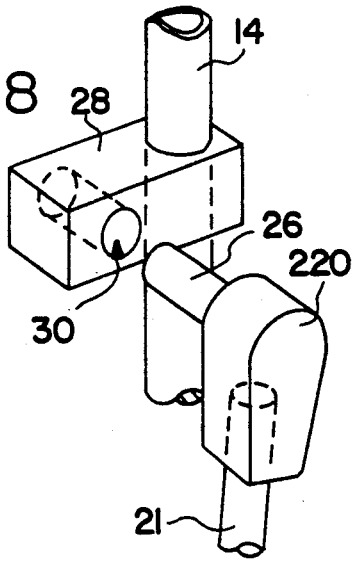
FIG. 8 is a perspective view of a detail of the embodiment of the stirrup-prop articulation system.

As shown in FIG. 7, the two axes of articulation (26, 27) converge at a point (M) located outside the bag. The lower part (32) of the stirrup piece, and in particular, the end of its lower central part (33) formed by a transverse section (34), constitutes the device controlling the support.

According to one feature of the invention, the control device lies in the half-space located above the plane (Q) formed by the support surface (12) of the bottom of the bag beyond the plane (T) containing the two arms (14, 15), so that it is positioned at a distance (d) from the point (C) of support of the bag when the latter is in the inclined position. To accomplish this, the transverse section (34) is connected to the ends (221, 231) of the respective arms (22, 23) by intermediate, substantially horizontal sections (340, 341).

Furthermore, the stirrup piece, and in particular the lower parts of these arms (22, 23), are slidingly retained against the wall of the bag by a retention device (35) comprising a slot (36) through which they can travel vertically upwardly in direction (H) and downwardly in direction (B).

To provide for the elastic return of the props (14, 15) to their resting position against the bag, the elastic stirrup piece (21) is made of a steel wire having a circular section and is prestressed toward a closed position in direction (U), so that the two arms (22) and (23) tend to move toward each other. Thus, in the resting position (FIG. 2), by virtue of the action (f) of its free ends, the stirrup piece draws back and holds the props (24, 25) in the retracted position.

Figure 2:
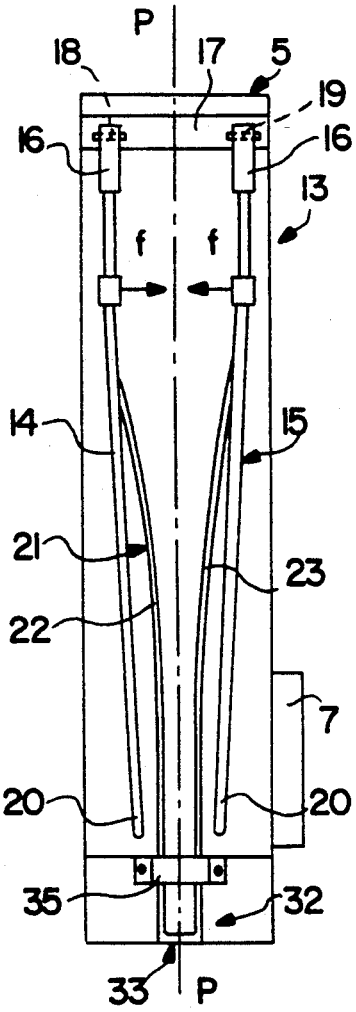
FIG. 2 is a view in the direction of arrow V2 in FIG. 1.
Figure 3:
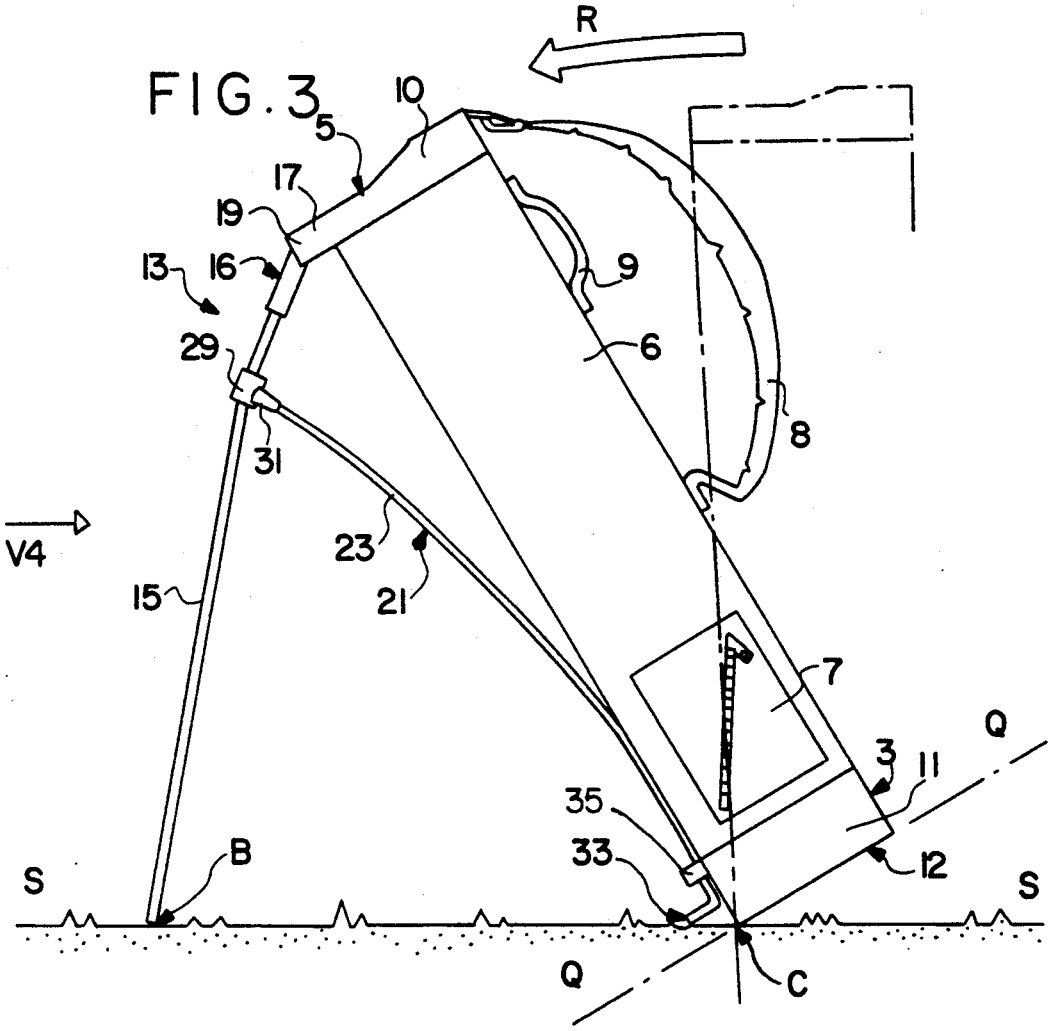
FIGS. 3 is a side view of the golf bag with its support in its extended position.
Figure 6:
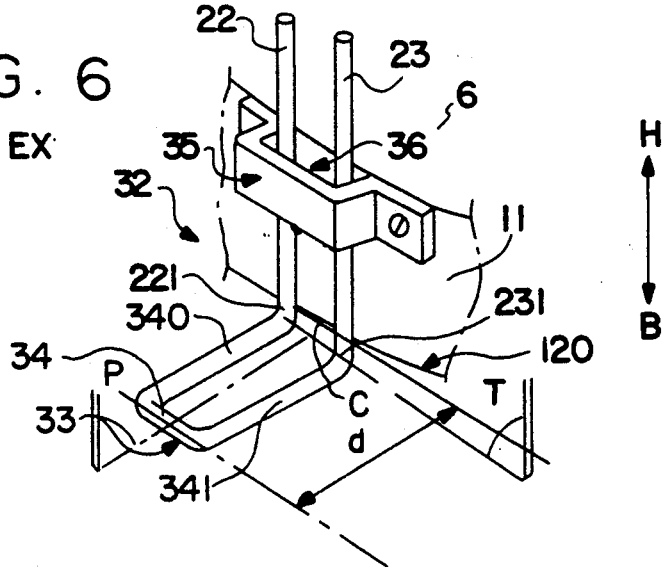
FIG. 6 is a partial perspective detailed view.

As shown in FIG. 3, the props are placed in the extended position in the following way:

The golfer places his bag vertically in the position shown in FIGS. 1 and 2. In this position, the bag is supported on the ground (S) over its entire support surface (12), and the props (14, 15) are in the retracted position against the bag. It is important to note that, in this position, the control device (33) does not extend downward beyond the bottom of the bag, and thus does not prove bothersome in any way.

Figure 4:
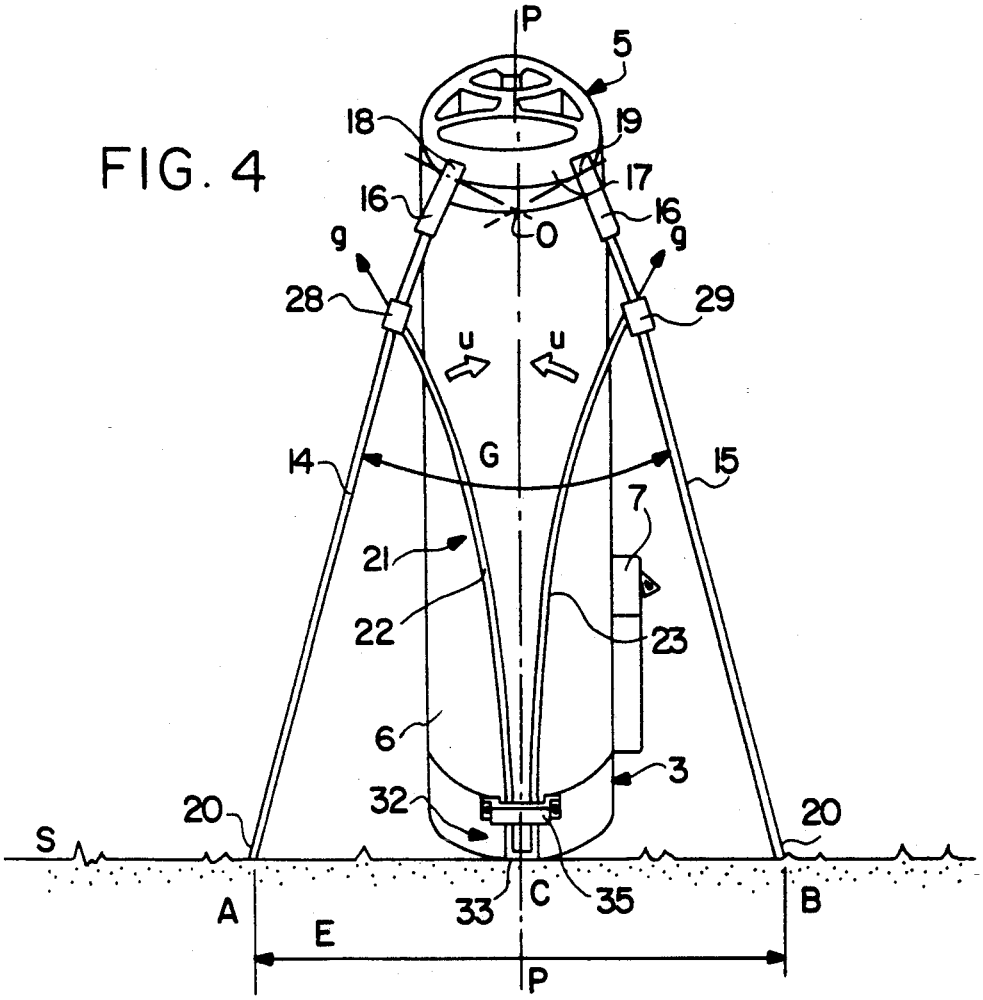
FIG. 4 is a view in the direction of arrow V4 in FIG. 3.

When the golfer wishes to place his bag in the inclined position, as shown in FIGS. 3 and 4, he need only tip his bag in plane (P) and in direction (R) (FIG. 3). During this movement, the bottom of the bag (12) pivots out of its supported position on the ground and around the pivot point (C) located on the periphery (220) of the bottom (12) and within the extension of the peripheral cover (6). Simultaneously, the control device (33) comes into contact with the ground (S) and is, accordingly, pushed upward in direction (H). The stirrup piece, guided by the retention device (35), then travels upward, and the upward action (g) generated by its ends on the props causes them to move into the extended position. The bag can then be placed in the position supported at three points (A, B, and C).

Figure 9:
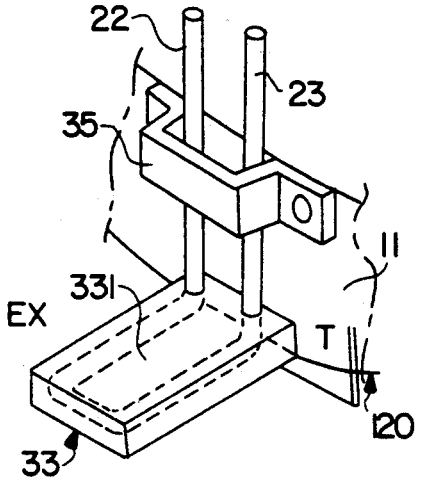
FIGS. 9, 10, and 11 are partial views showing variants of the control device.
Figure 11:
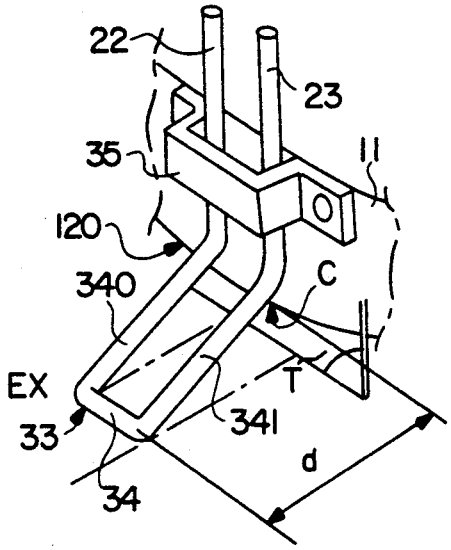
Figure 10:
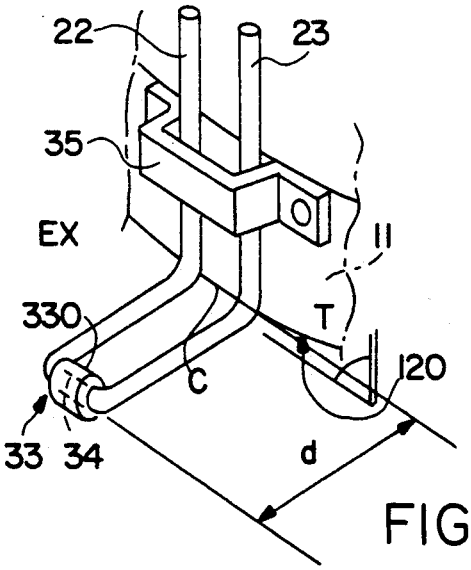

It should be noted that the lower end of the elastic stirrup piece (21), and in particular its control device, may be given various configurations. FIGS. 9, 10, and 11 illustrate possible variants.

In the variant of FIG. 9, a plastic operating piece (331) has been duplicate molded on the stirrup piece.

FIG. 10 shows a variant in which the operating device (33) comprises a roller (330) which rotates around the transverse section (34).

In the variant illustrated in FIG. 11, the intermediate sections (340, 341) are inclined in relation to the plane (Q) of the bottom of the bag.

Figure 12:
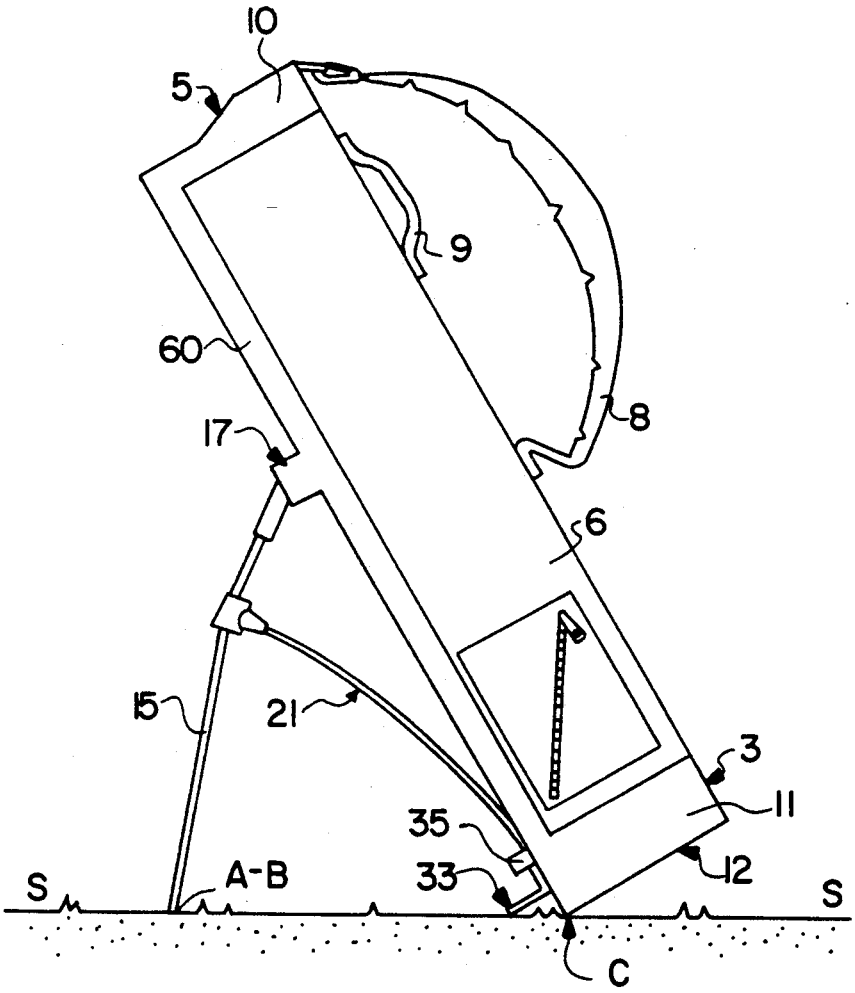
FIG. 12 is a view similar to FIG. 3, illustrating a variant.

The prop-equipped support may, of course, be so configured that the props are longer or shorter. FIG. 12 is a view similar to FIG. 3, illustrating a variant incorporating shorter props, in which the shoulder (17) is not connected to the upper shield (50, but is positioned between this upper shield (5) and the lower shield (3). The shoulder (17) is thus attached to the peripheral wall (6) of the bag and is, for example, joined to a support piece (60).

Figure 5:
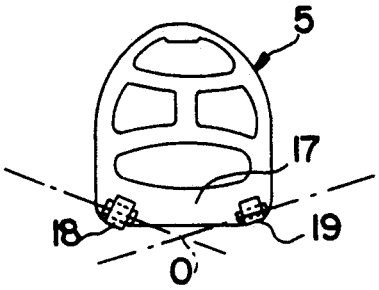
FIG. 5 is a top view showing the upper shield of the golf bag in greater detail.
Figure 5A:
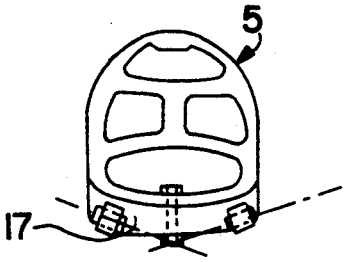
FIG. 5*a* is a view similar to FIG. 5, illustrating a variant.

It should be noted that, in the event the shoulder is attached to the upper shield (5), the shoulder (17) to which the props (14, 15) are jointed can either be molded with the upper shield, as shown in FIG. 5, or mounted and fastened to it, as shown in FIG. 5*a*.

I claim:

1. Golf bag constituted by an upper end shield (5) connected to a lower end shielded (3) by means of a peripheral cover (6) and comprising a support (13) incorporating two props (14, 15), each of said props being jointed by an upper end of said prop to said golf bag around a respective axis (18, 19) for pivoting movement between a retracted resting position and an extended position, said props being stressed into their retracted resting position by an elastic system constituted by an elastic U-shaped stirrup piece (21) comprising two upwardly extending arms (22, 23) having free ends (24, 25) respectively fastened to said props by joints, a lower end (26, 27), of said stirrup piece terminating in a rigid prolongation constituted by an operating device (33) extending outwardly from said peripheral cover (6) so as to lie outside of a plane (T) containing said two arms (22, 23) and at a distance (d) from a point (c) of support of said gold bag when said golf bag is in inclined position.

2. Golf bag according to claim 1, wherein said lower shield (3) has a lower periphery (120) which lies substantially in an extension of a wall of said peripheral cover (6), said point of support being located on said lower periphery (120).

3. Golf bag according to clam 2, wherein said lower part of said arms (22, 23) of said elastic stirrup piece (21) is held in a vertical sliding configuration by a retention device (35) attached to said golf bag.

4. Golf bag according to claim 3, wherein said props (14, 15) have axes of articulation (18, 19) which converge at a point (O) located outside said golf bag.

5. Golf bag according to clam 4, wherein said stirrup piece (21) has axes of articulation (26, 27) on said props (14, 15) which converge at a point (M) located outside of said golf bag.

6. Golf bag according to claim 5, wherein said props (18, 19) are articulated on a shoulder (17) unitary with said upper shield (5).

7. Golf bag according to claim 6, wherein said shoulder (17) is mounted on said upper shield (5).

8. Golf bag according to claim 6, wherein said shoulder (17) is molded with said upper shield (5).

9. Golf bag according to claim 5, wherein said props (18, 19) are jointed on a shoulder (17) unitary with said bag, and are positioned between said upper shield (5) and said lower shield (3).

10. Golf bag according to claim 1, wherein said U-shaped stirrup piece (21) is prestressed toward said retracted resting position, so that said two arms (22, 23) tend to move toward each other.

11. Gold bag according to claim 1, wherein said operating device (33) is positioned in a half-space located above a plane (Q) formed by a support surface of a bottom (12) of said golf bag.

* * * * *